US011970809B2

(12) United States Patent
Chung et al.

(10) Patent No.: US 11,970,809 B2
(45) Date of Patent: Apr. 30, 2024

(54) MULTI BASKET LAUNDRY TREATMENT APPLIANCE AND METHOD OF USING THE SAME

(71) Applicant: Haier US Appliance Solutions, Inc., Wilmington, DE (US)

(72) Inventors: Myunggeon Chung, Seoul (KR); Wonshik Choi, Seoul (KR); Youn-Ki Min, Seoul (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 81 days.

(21) Appl. No.: 17/591,842

(22) Filed: Feb. 3, 2022

(65) Prior Publication Data

US 2023/0243080 A1 Aug. 3, 2023

(51) Int. Cl.

| | |
|---|---|
| ***D06F 33/46*** | (2020.01) |
| ***D06F 34/18*** | (2020.01) |
| ***D06F 37/12*** | (2006.01) |
| *D06F 103/04* | (2020.01) |

(52) U.S. Cl.

CPC ..... *D06F 33/46* (2020.02); *D06F 34/18* (2020.02); *D06F 37/12* (2013.01); *D06F 2103/04* (2020.02)

(58) Field of Classification Search

CPC ..... D06F 29/00; D06F 31/00; D06F 33/30; D06F 33/46; D06F 33/70; D06F 33/72; D06F 34/28; D06F 34/32; D06F 2101/00; D06F 2101/02; D06F 2101/04; D06F 2101/06; D06F 2101/12; D06F 2101/20; D06F 2105/00; D06F 2105/50; D06F 2105/52; D06F 2105/54

See application file for complete search history.

(56) References Cited

U.S. PATENT DOCUMENTS

| | | | |
|---|---|---|---|
| 10,466,665 | B2 | 11/2019 | Belveal et al. |
| 10,614,440 | B2 | 4/2020 | Benkreira et al. |
| 2019/0017212 | A1 | 1/2019 | Bergamo et al. |
| 2022/0195649 | A1* | 6/2022 | Johansson ..... D06F 34/28 |

FOREIGN PATENT DOCUMENTS

| | | | |
|---|---|---|---|
| CN | 107967643 | A | 4/2018 |

* cited by examiner

*Primary Examiner* — David G Cormier
(74) *Attorney, Agent, or Firm* — Dority & Manning, P.A.

(57) ABSTRACT

A laundry treatment appliance includes a cabinet; a wash tub provided within the cabinet, the wash tub comprising an axial column, the axial column configured to receive multiple wash baskets stacked axially; and a controller provided within the cabinet. The controller is configured for receiving wash cycle requests from a plurality of unique users, each of the wash cycle requests having a corresponding set of wash parameters; matching a first unique user and a second unique user from the plurality of unique users according to the corresponding set of wash parameters; determining a first individual cost for the first unique user and a second individual cost for the second unique user; receiving a confirmation from each of the first and second unique users; and generating a joint washing operation in accordance with the set of washing parameters.

20 Claims, 6 Drawing Sheets

MULTI BASKET LAUNDRY TREATMENT APPLIANCE AND METHOD OF USING THE SAME

FIELD OF THE INVENTION

The present subject matter relates generally to laundry treatment appliances, and more particularly to laundry appliances utilizing multiple baskets.

BACKGROUND OF THE INVENTION

Conventional laundry treatment appliances typically include a wash tub for holding water and a wash basket rotatably provided within the wash tub. Articles to be washed, such as clothing, bedding, towels, and the like, are placed within the wash basket where water and detergent are supplied to perform a washing operation. Some users of laundry treatment appliances utilize large scale facilities, such as public laundromats. These laundromats include multiple machines including washing machines and dryers. Each washing (or drying) operation performed within a machine carries a cost. Often times, this cost is a fixed fee, regardless of the size of the load, the amount of water used, and other factors.

In many washing operations, users will separate out articles to be washed into like categories, such as delicates, whites, colors, sheets, and the like. This may result in some washing loads to be lighter or smaller than others. For instance, a single user may only own several items deemed delicate, which often is not enough to justify running an entire washing operation. However, a user may not wish to pay a fee for a full operating cycle of the appliance when only a fraction of its capacity is used. Moreover, energy and resources such as water would be wasted in performing large washing operations with fractional washing loads.

Accordingly, a laundry treatment appliance that obviates one or more of the above-mentioned drawbacks would be beneficial. In particular, a laundry treatment appliance capable of accepting multiple different washing loads and distributing cost evenly would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a laundry treatment appliance is provided. The laundry treatment appliance may include a cabinet defining a receiving space; a wash tub provided within the receiving space, the wash tub including an axial column, the axial column configured to receive multiple wash baskets stacked axially; and a controller provided within the cabinet. The controller may be configured for receiving wash cycle requests from a plurality of unique users, wherein each of the wash cycle requests includes a corresponding set of wash parameters; matching a first unique user and a second unique user from the plurality of unique users according to the corresponding set of wash parameters; determining a first individual cost for the first unique user and a second individual cost for the second unique user in response to matching the first unique user and the second unique user; receiving a confirmation from each of the first and second unique users; and generating a joint washing operation in accordance with the corresponding set of washing parameters.

In another exemplary aspect of the present disclosure, a method of operating a laundry treatment appliance is provided. The laundry treatment appliance may include a cabinet, a wash tub provided within the cabinet, and multiple wash baskets stacked axially within the wash tub. The method may include receiving wash cycle requests from a plurality of unique users, wherein each of the wash cycle requests include a corresponding set of wash parameters; matching a first unique user and a second unique user from the plurality of unique users according to the corresponding set of wash parameters; determining a first individual cost for the first unique user and a second individual cost for the second unique user in response to matching the first unique user and the second unique user; receiving a confirmation from each of the first and second unique users; and generating a joint washing operation in accordance with the corresponding set of washing parameters.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
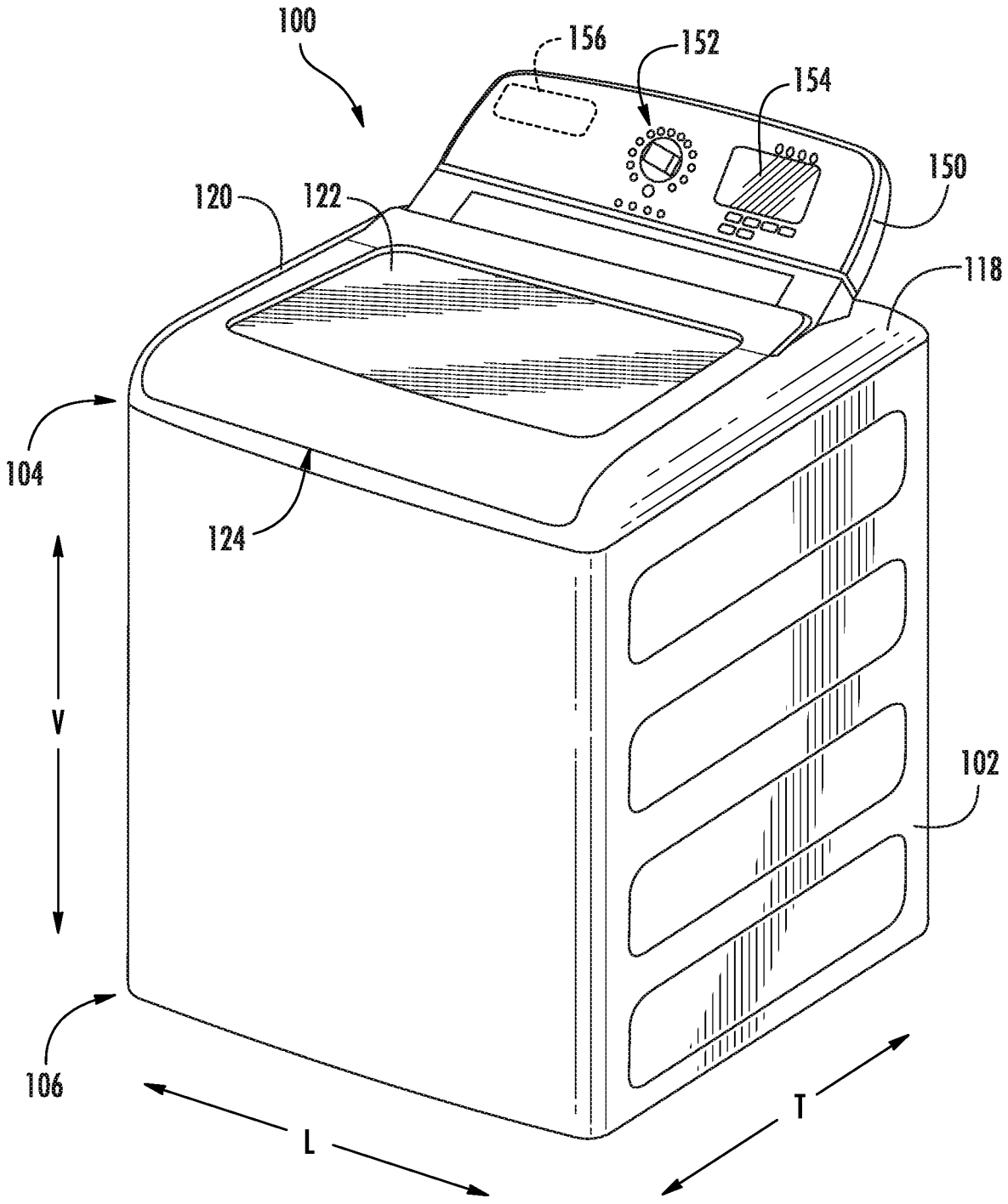
FIG. 1 provides a perspective view of a laundry machine appliance with a lid in a closed position according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
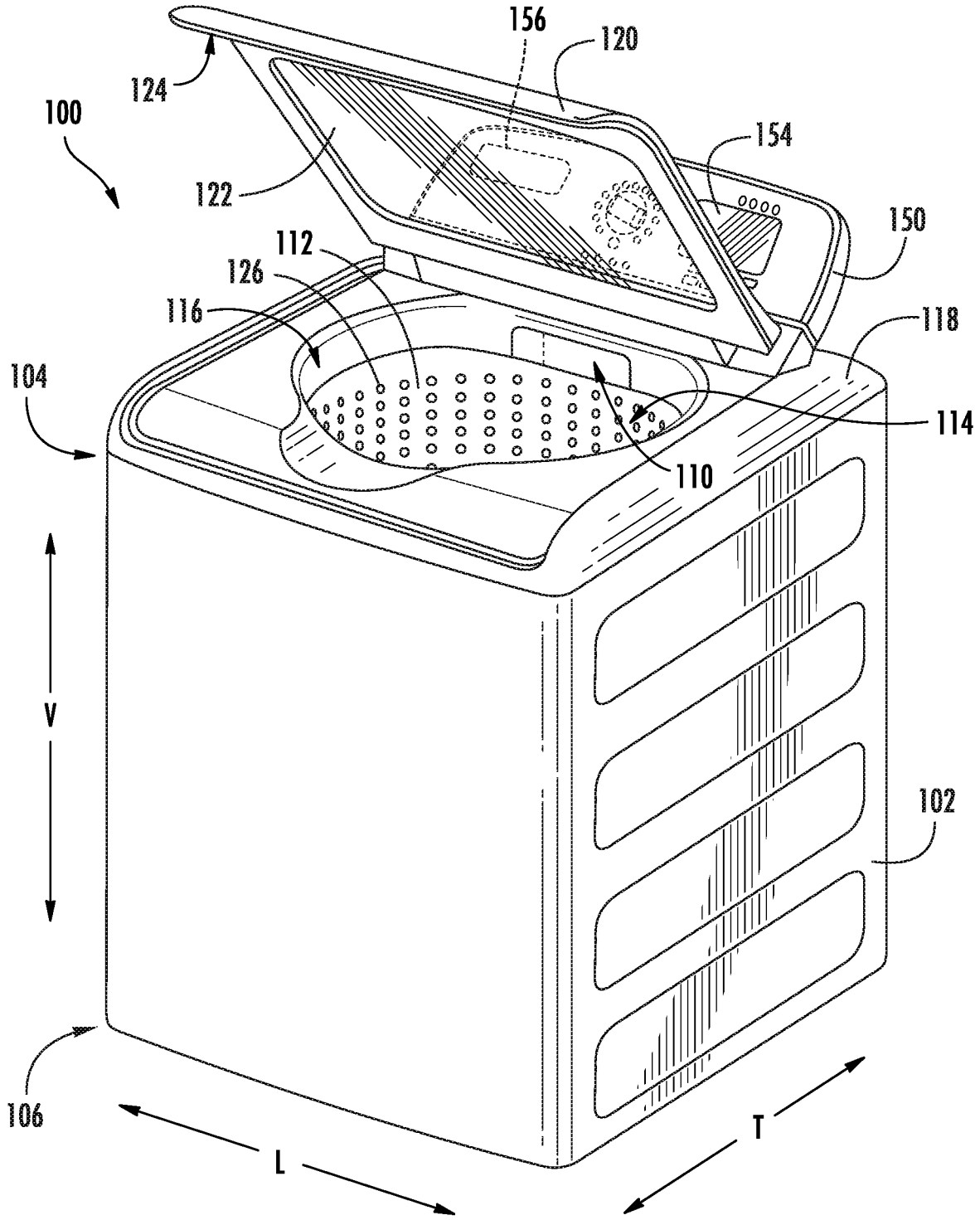
FIG. 2 provides a perspective view of the exemplary laundry machine appliance of FIG. 1 with the lid in an open position.
Figure 3:
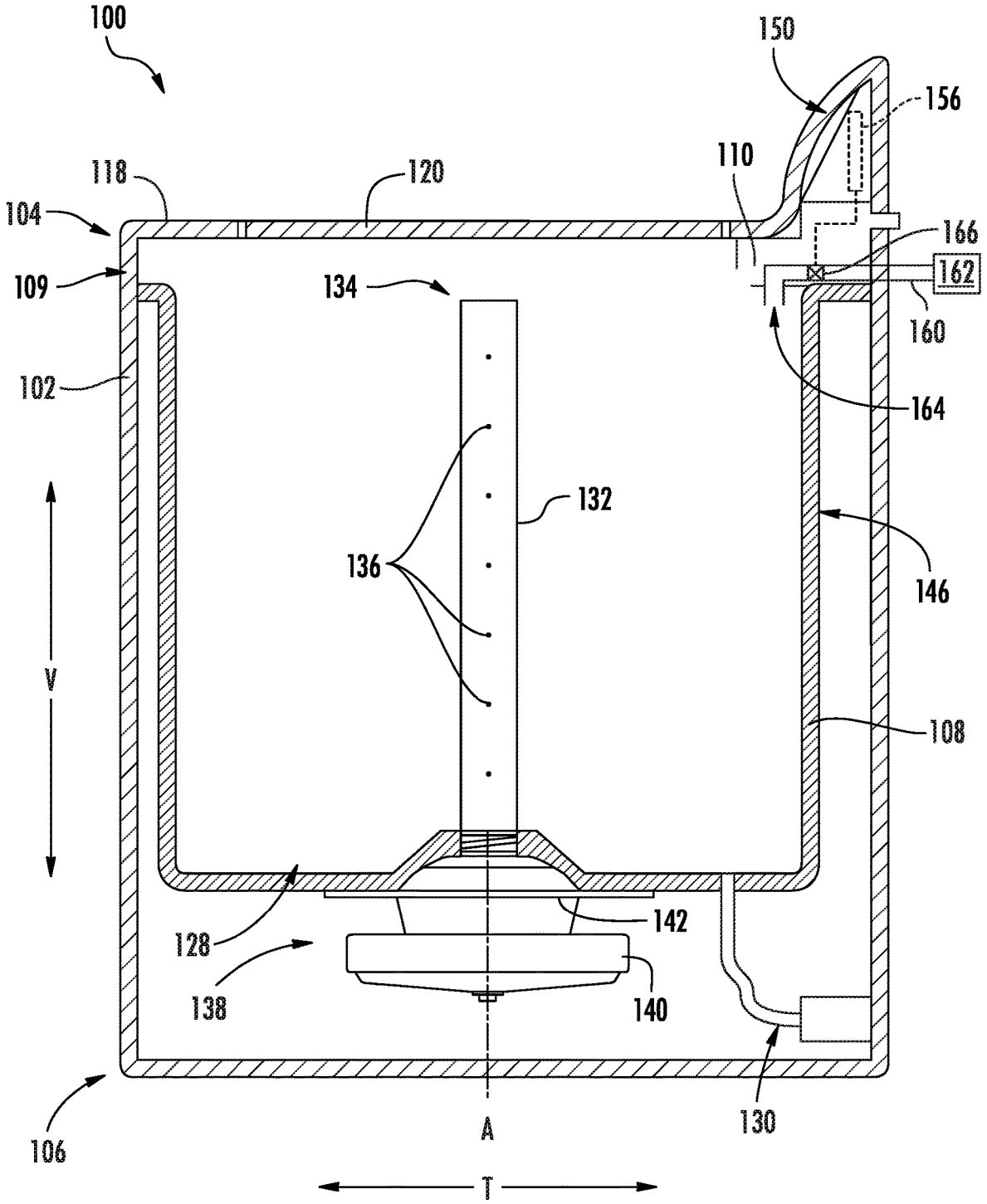
FIG. 3 provides a cut-away side view of the exemplary laundry machine appliance of FIG. 1.

FIGS. 1 through 3 illustrate an exemplary embodiment of a vertical axis laundry machine appliance or laundry treatment appliance (e.g., such as a washing machine) 100. Specifically, FIGS. 1 and 2 illustrate perspective views of laundry machine appliance 100 in a closed and an open position, respectively. FIG. 3 provides a side cross-sectional view of laundry machine appliance 100. Laundry machine appliance 100 generally defines a vertical direction V, a lateral direction L, and a transverse direction T, each of which is mutually perpendicular, such that an orthogonal coordinate system is generally defined.

While described in the context of a specific embodiment of a vertical axis laundry machine, it should be appreciated that vertical axis laundry machine appliance 100 is provided by way of example only. It will be understood that aspects of the present subject matter may be used in any other suitable laundry machine appliance, such as a horizontal axis laundry machine appliance. Indeed, modifications and variations may be made to laundry machine appliance 100, including different configurations, different appearances, and/or different features while remaining within the scope of the present subject matter. For instance, laundry machine appliance 100 may be a combination washing machine and dryer appliance.

Laundry machine appliance 100 has a cabinet 102 that extends between a top portion 104 and a bottom portion 106 along the vertical direction V. As best shown in FIG. 3, a tub 108 is positioned within cabinet 102 and is generally configured for retaining wash fluids during an operating cycle (e.g., a washing cycle). Laundry machine appliance 100 further includes a primary dispenser 110 (FIG. 2) for dispensing wash fluid into tub 108. The term "wash fluid" refers to a liquid used for washing and/or rinsing articles during an operating cycle and may include any combination of water, detergent, fabric softener, bleach, and other wash additives or treatments. Further, it should be noted that primary dispenser 110 is provided by way of example only, and that laundry machine appliance 100 may incorporate any suitable form of detergent dispenser, including manual fill dispensers.

In addition, laundry machine appliance 100 may include one or more removable wash baskets 112 selectively positioned within tub 108 and generally defining one or more wash chambers 114. For instance, an opening 116 may be formed in cabinet 102 for receipt of articles for washing (e.g., for receipt of one or more removable wash baskets). More specifically, wash basket 112 (e.g., one or more) may be rotatably mounted within tub 108 such that it is rotatable about an axis of rotation A. According to the illustrated embodiment, the axis of rotation A is substantially parallel to the vertical direction V. In this regard, laundry machine appliance 100 is generally referred to as a "vertical axis" or "top load" laundry machine appliance 100. However, as noted above, it should be appreciated that aspects of the present subject matter may be used within the context of a horizontal axis or front load laundry machine appliance as well.

As illustrated, cabinet 102 of laundry machine appliance 100 has a top panel 118. Top panel 118 may define opening 116 of to permit a user access to tub 108. Laundry machine appliance 100 may further include a door 120 which is rotatably mounted to top panel 118 to permit selective access to opening 116. In particular, door 120 may selectively rotate between the closed position (as shown in FIGS. 1 and 3) and the open position (as shown in FIG. 2). In the closed position, door 120 inhibits access to tub 108 (and, selectively, one or more wash baskets 112). Conversely, in the open position, a user can access wash basket 112. A window 122 in door 120 may permit viewing of wash basket 112 when door 120 is in the closed position, e.g., during operation of laundry machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As shown in FIG. 3, tub 108 may include an axial column 132. In detail, axial column 132 may extend (e.g., along the vertical direction V) from a bottom of tub 108. Axial column 132 may be positioned at an axial center of tub 108. For instance, axial column 132 may be concentric with axis of rotation A. A top 134 of axial column 132 may be coplanar with a top edge 109 of tub 108. In detail, axial column 132 may extend to the top of tub 108. According to at least some embodiments, axial column 132 is connected to motor 140 (described below). Accordingly, axial column 132 may be selectively rotated (e.g., about axis of rotation A) by motor 140. Additionally or alternatively, axial column 132 may include one or more rotating portions provided therein which are rotated by the motor to selectively rotate the one or more wash baskets 112 attached thereto.

Axial column 132 may include one or more locking mechanisms 136. For instance, the one or more locking mechanisms 136 may protrude from a circumferential surface of axial column 132 (e.g., radially from axial column 132 perpendicular to axis of rotation A). Locking mechanisms 136 may selectively lock wash basket 112 to axial column 132 such that wash basket 112 rotates together with axial column 132 (e.g., by way of motor 140). Locking mechanisms 136 may be positioned at regular intervals axially (e.g., vertically) along axial column 132. Accordingly, one or more wash baskets 112 (e.g., of varying size, described below) may be selectively coupled to axial column 132 at a time. For at least one example, a medium sized wash basket and a small sized wash basket (described below) may both be attached to axial column simultaneously. Moreover, it should be noted that locking mechanisms 136 may take any suitable form. For instance, locking mechanisms 136 may be magnets, catches, keys, key holes, spring assisted ball bearings, or the like, and the disclosure is not limited to the examples given herein.

Figure 4:
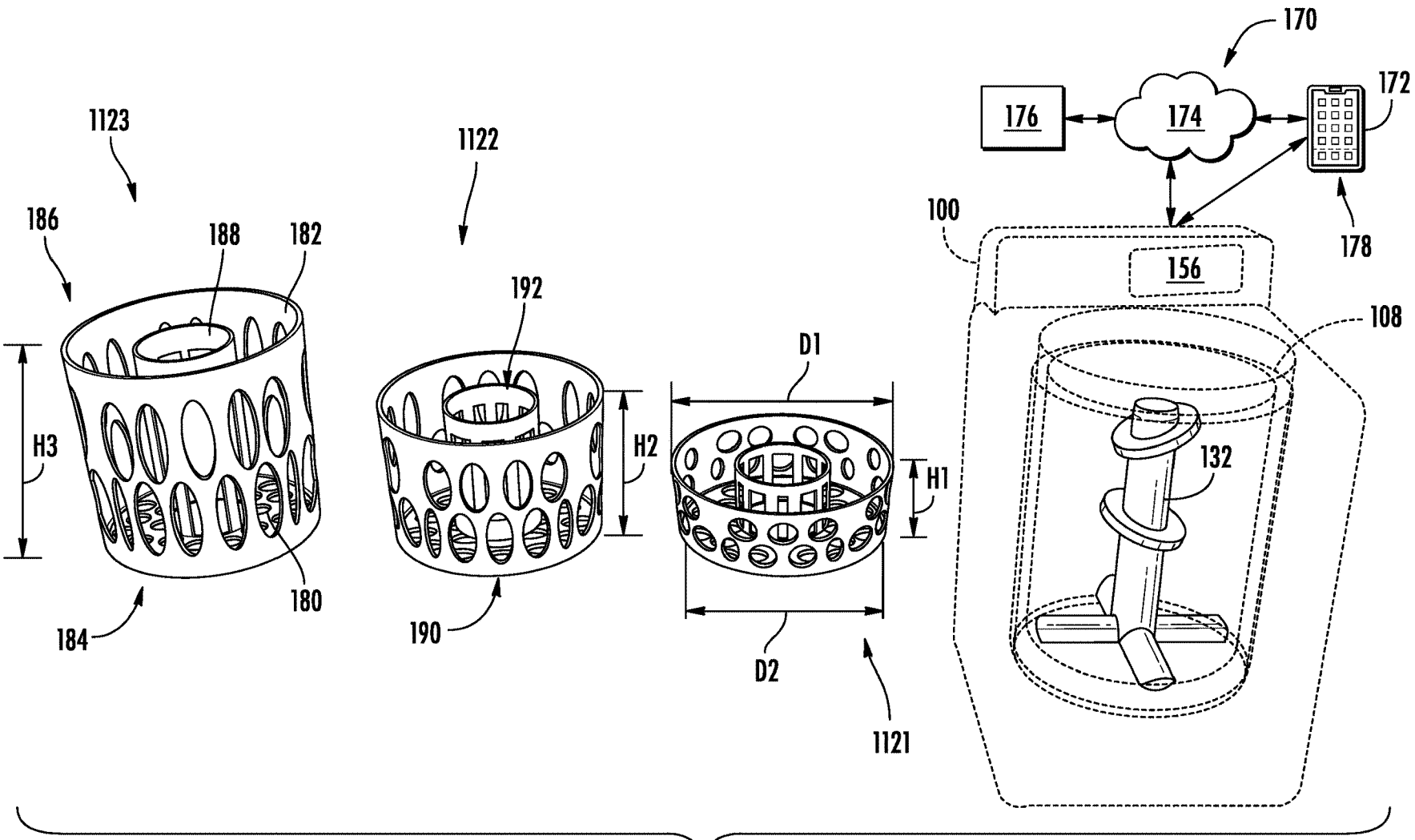
FIG. 4 provides a perspective view of an exemplary laundry machine appliance with different sized removable baskets.
Figure 5:
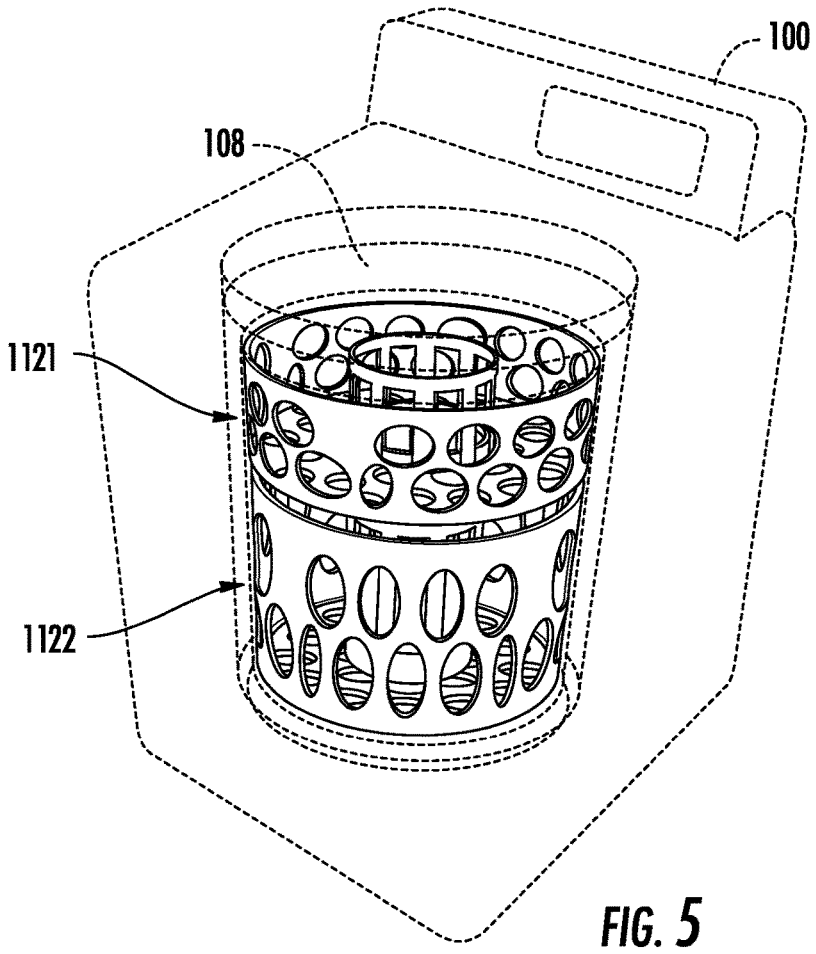
FIG. 5 provides a perspective view of the exemplary laundry machine appliance of FIG. 4 with two baskets inserted therein.

As mentioned above, tub 108 may be configured to selectively receive a plurality of wash baskets 112. Referring briefly to FIG. 4, the plurality of wash baskets 112 may include a small wash basket 1121, a medium wash basket 1122, and a large wash basket 1123. For this description, wash basket 112 will be described generally in detail with the understanding that like reference numerals refer to like features within each of the small, medium, and large wash baskets 1121, 1122, 1123. Notable differences will be mentioned herein after. Additionally or alternatively, it should be understood that the small, medium, and large size wash baskets are provided as examples only, and that more or fewer different varying sizes may be incorporated.

As best shown in FIGS. 2 and 4 through 6, wash basket 112 defines a plurality of perforations 126 to facilitate fluid communication between an interior of wash basket 112 and tub 108. In this regard, wash basket 112 is spaced apart from tub 108 to define a space for wash fluid to escape wash chamber 114. During a spin cycle, wash fluid within articles of clothing and within wash chamber 114 is urged through perforations 126 wherein it may collect in a sump 128 defined by tub 108. Laundry machine appliance 100 may further include a pump assembly 130 (FIG. 3) that is located beneath tub 108 and wash basket 112 for gravity assisted flow when draining tub 108, e.g., after a wash or rinse cycle.

Wash basket 112 may include a perforated bottom panel 180. For instance, perforated bottom panel 180 may be predominantly circular. In detail, perforated bottom panel 180 is donut-shaped, defining a large opening 182 at an axial center thereof. The opening 182 may be sized so as to accept axial column 132 therethrough. Accordingly, a plurality of wash baskets 112 may be stacked axially onto axial column 132 (e.g., within tub 108). Furthermore, it should be noted that the top load washing machine appliance 100 shown in the figures is provided by way of example only. Accordingly, the axial column 132, shown as extending along the vertical direction V, may in some embodiments extend along a horizontal direction (e.g., the lateral direction L or the transverse direction T), or to some varying degree therebetween.

Wash basket 112 may further include a perforated external wall 182. In detail, perforated external wall 182 may be cylindrical. Perforated external wall 182 may include a plurality of perforations 126 formed therethrough. Perforated external wall 182 may extend from perforated bottom panel 180 (e.g., along the vertical direction V, or parallel to the axis of rotation A). Accordingly, a bottom 184 of perforated external wall 182 may be connected with perforated bottom panel 180 and a top 186 of perforated external wall 182 may be distal to bottom 184. According to some embodiments, a diameter D1 of perforated external wall 182 at the top 186 may be larger than a diameter D2 of perforated external wall 182 at the bottom 184. Thus, perforated external wall 182 may be tapered inward toward bottom 184. Advantageously, multiple wash baskets 112 may be stacked (e.g., axially) along axial column 132 within tub 108.

Wash basket 112 may further include a central wall 188. In detail, central wall 188 may be cylindrical. Central wall 188 may extend from perforated bottom panel 180 (e.g., along the vertical direction V, or parallel to the axis of rotation A). Accordingly, a bottom 190 of central wall 188 may be connected with perforated bottom panel 180 and a top 192 of central wall 188 may be distal to bottom 190. According to at least some embodiments, top 192 of central wall 188 may be coplanar (e.g., along the lateral and transverse directions L, T) with top 186 of perforated external wall 182. Central wall 188 may include one or more perforations therethrough. For instance, a plurality of axial perforations 194 may be formed through central wall 188. According to at least some embodiments, axial perforations 194 may selectively interact with the one or more locking mechanisms 136 on axial column 132. In detail, upon inserting wash basket 112 into tub and over axial column 132, a locking mechanism 136 may extend into an axial perforation 194 defined in central wall 188. Accordingly, wash basket 112 may be coupled to axial column 132 so as to be rotated therewith.

As mentioned above, tub 108 may be configured to receive multiple wash baskets 112 therein. For instance, a plurality of combinations of small wash basket 1121, medium wash basket 1122, and large wash basket 1123 may be accommodated within tub 108. In detail, in order to efficiently accommodate each combination within tub 108, small wash basket 1121, medium wash basket 1122, and large wash basket 1123 may each have identical diameters (e.g., D1 at a top and D2 at a bottom). However, the volumes within each wash basket 112 (e.g., between perforated external wall 182 and central wall 188) may vary. Accordingly, a height of each of small wash basket 1121, medium wash basket 1122, and large wash basket 1123 may differ. For this description, the "height" of each wash basket 112 is measured along the vertical direction V, or parallel to the axis of rotation A.

For instance, small wash basket 1121 may have a first height H1. First height H1 may be, for example, between about 4 inches and about 6 inches. In detail, first height H1 is measured from perforated bottom panel 180 to top 186 of perforated external wall 182. Moreover, medium wash basket 1122 may have a second height H2. Second height H2 may be, for example, between about 8 inches and about 12 inches. Large wash basket 1123 may have a third height H3. Third height H3 may be, for example, between about 14 inches and about 20 inches. Thus, H3>H2>H1.

Figure 6:
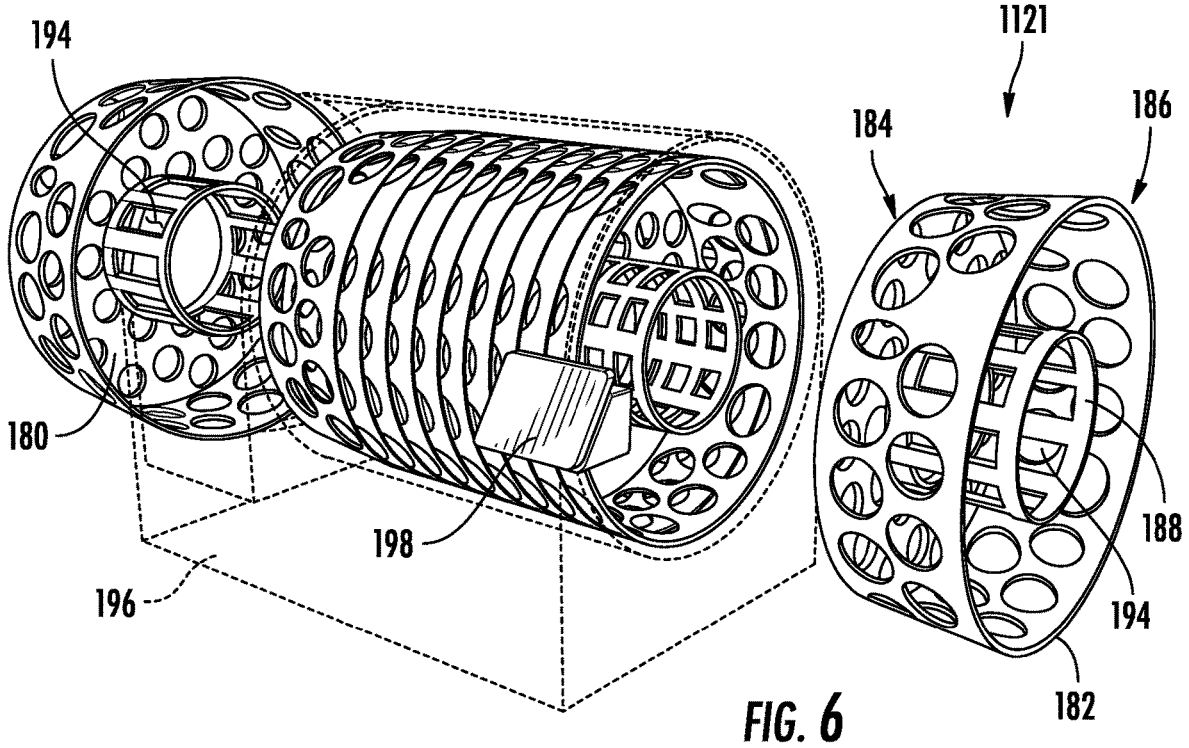
FIG. 6 provides a perspective view of an exemplary basket dispensing apparatus according to embodiments of the present disclosure.

With reference to FIG. 6, a basket distribution unit 196 may selectively store and distribute wash baskets 112. For instance, basket distribution unit 196 may be provided at select laundromats incorporating one or more washing machine appliances 100. Basket distribution unit 196 may store a plurality of wash baskets 112 therein to be retrieved by unique users. For example, three basket distribution units 196 may be provided, one each for small wash baskets 1121, medium wash baskets 1122, and large wash baskets 1123. Basket distribution unit 196 may include an electronic reader 198. In detail, electronic reader 198 may be a near field communication (NFC) reader which may recognize a unique user. Accordingly, basket distribution unit 196 may release the appropriate wash basket 112 to the correct unique user upon demand.

As best illustrated in FIG. 3, laundry machine appliance 100 includes a drive assembly 138 in mechanical communication with wash basket 112 (e.g., through axial column 132) to selectively rotate wash basket 112 (e.g., during an agitation or a rinse cycle of laundry machine appliance 100). In addition, drive assembly 138 may also be in mechanical communication with axial column 132. In this manner, drive assembly 138 may be configured for selectively rotating or oscillating wash basket 112 and/or axial column 132 during various operating cycles of laundry machine appliance 100.

More specifically, drive assembly 138 may generally include one or more of a drive motor 140 and a transmission assembly 142, e.g., such as a clutch assembly, for engaging and disengaging wash basket 112 and/or axial column 132. According to the illustrated embodiment, drive motor 140 is a brushless DC electric motor, e.g., a pancake motor. However, according to alternative embodiments, drive motor 140 may be any other suitable type of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Referring to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of laundry machine appliance 100 may be controlled by a controller or processing device 156 that is communicatively coupled with control panel 150 for user manipulation to select washing machine cycles and features. In response to user manipulation of control panel 150, controller 156 may operate the various components of laundry machine appliance 100 to execute selected machine cycles and features. Controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of laundry machine appliance 100 may be in communication with controller 156 via one or more signal lines or shared communication busses. Additionally or alternatively, controller 156 may include one or more wireless communication modules for wirelessly connecting with external devices.

Referring still to FIG. 1, a schematic diagram of an external communication system 170 will be described according to an exemplary embodiment of the present subject matter. In general, external communication system 170 is configured for permitting interaction, data transfer, and other communications between washing machine appliance 100 and one or more external devices. For example, this communication may be used to provide and receive operating parameters, user instructions or notifications, performance characteristics, user preferences, or any other suitable information for improved performance of washing machine appliance 100. In addition, it should be appreciated that external communication system 170 may be used to transfer data or other information to improve performance of one or more external devices or appliances and/or improve user interaction with such devices.

For example, external communication system 170 permits controller 156 of washing machine appliance 100 to communicate with a separate device external to washing machine appliance 100, referred to generally herein as an external device 172. As described in more detail below, these communications may be facilitated using a wired or wireless connection, such as via a network 174. In general, external device 172 may be any suitable device separate from washing machine appliance 100 that is configured to provide and/or receive communications, information, data, or commands from a user. In this regard, external device 172 may be, for example, a personal phone, a smartphone, a tablet, a laptop or personal computer, a wearable device, a smart home system, or another mobile or remote device.

In addition, a remote server 176 may be in communication with washing machine appliance 100 and/or external device 172 through network 174. In this regard, for example, remote server 176 may be a cloud-based server 176, and is thus located at a distant location, such as in a separate state, country, etc. According to an exemplary embodiment, external device 172 may communicate with a remote server 176 over network 174, such as the Internet, to transmit/receive data or information, provide user inputs, receive user notifications or instructions, interact with or control washing machine appliance 100, etc. In addition, external device 172 and remote server 176 may communicate with washing machine appliance 100 to communicate similar information.

In general, communication between washing machine appliance 100, external device 172, remote server 176, and/or other user devices or appliances may be carried using any type of wired or wireless connection and using any suitable type of communication network, non-limiting examples of which are provided below. For example, external device 172 may be in direct or indirect communication with washing machine appliance 100 through any suitable wired or wireless communication connections or interfaces, such as network 174. For example, network 174 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Referring to FIG. 3, laundry machine appliance 100 may include a water supply conduit 160 that provides fluid communication between a water supply source 162 (such as a municipal water supply) and a discharge nozzle 164 for directing a flow of water into tub 108, and more specifically, into wash chamber 114. In addition, laundry machine appliance 100 may include a water fill valve or water control valve 166 which is fluidly coupled with water supply conduit 160 and communicatively coupled to controller 156. In this manner, controller 156 may regulate the operation of water control valve 166 to regulate the amount of water within tub 108.

Figure 7:
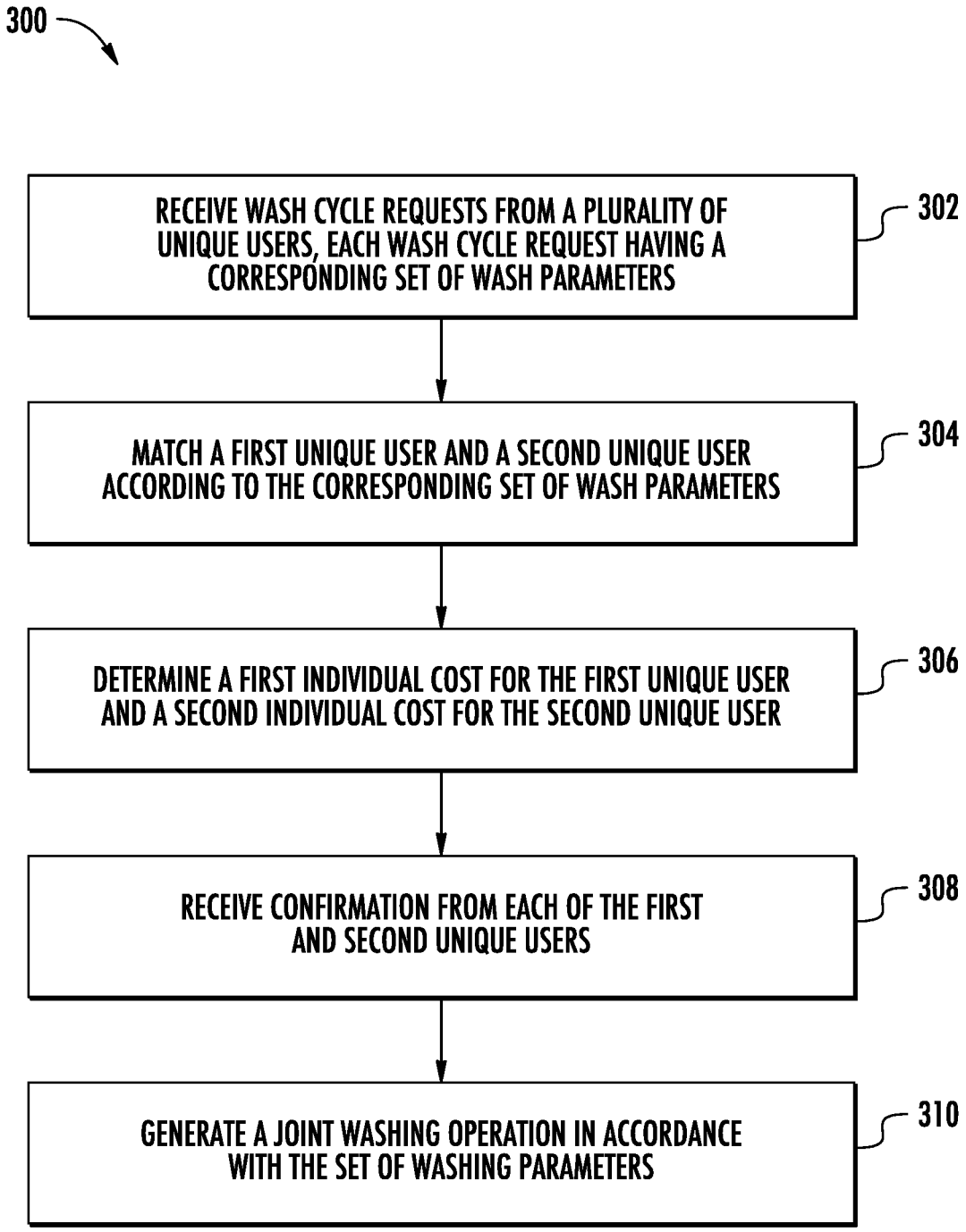
FIG. 7 provides a flow chart illustrating a method of operating a laundry machine appliance.

Now that the general descriptions of an exemplary washing machine appliance have been described in detail, a method 300 of operating an appliance (e.g., washing machine appliance 100) will be described in detail. Although the discussion below refers to the exemplary method 300 of operating washing machine appliance 100, one skilled in the art will appreciate that the exemplary method 300 is applicable to any suitable domestic appliance capable of performing a washing operation (e.g., such as a combination washing machine/dryer, a stand-alone washer, etc.). In exemplary embodiments, the various method steps as disclosed herein may be performed by controller 156 and/or a separate, dedicated controller. FIG. 7 provides a flow chart illustrating a method of operating a washing machine appliance. Hereinafter, method 300 will be described with specific reference to FIG. 7.

For reference, the washing machine appliance described herein may be a communal washing machine appliance, such as a public washing machine at a laundromat. In particular, the method described herein may incorporate two or more unique users into a single joint washing operation. According to the description above, a plurality of wash baskets may be accommodated within the wash tub, allowing multiple users to place individual baskets into a single machine to perform the joint washing operation. Thus, as will be described herein, a joint washing operation for multiple users may be performed in a single machine at once.

At step 302, method 300 may include receiving wash cycle requests from a plurality of users, each wash cycle request having a corresponding set of wash parameters. In detail, a controller (e.g., controller 156) within the washing machine (e.g., washing machine appliance 100) may receive a plurality of wash cycle requests from a plurality of users. For instance, a plurality of unique users may each input a wash request through a mobile application on a mobile device, such as a mobile telephone. The wash requests may include one or more corresponding wash parameters.

For example, the wash parameters may include a size of a wash load (e.g., per unique user), an according wash basket size, a type of washing article (e.g., delicate, white, towel, sheet, etc.), a color of washing article, a size of washing articles (e.g., bulky, oversized, etc.), a temperature of wash water, or the like. It should be noted that this list of potential wash parameters is not exhaustive, and additional parameters may be included. Additionally or alternatively, the corresponding wash parameters may include a date for performing the associated joint washing operation, and a time of day for performing the joint washing operation. The controller may then sort each wash cycle request and begin to clump similar users together according to the corresponding wash parameters (e.g., users seeking a wash cycle for a small load of delicates on a specified date).

At step 304, method 300 may include matching a first unique user and a second unique user according to the corresponding set of wash parameters. In detail, the controller may match two or more unique users having matching or corresponding wash parameters in their wash cycle requests. For at least one example, the controller matches a first unique user with a second unique user such that the wash parameters are appropriate for the joint washing operation (e.g., appropriate wash basket size, etc.). At this point, the controller may notify each of the first unique user and the second unique user as to the match. For instance, an alert may be pushed to each unique user's mobile device notifying them of the match. Included in the notification may be a brief description of the matched user as well as a picture and previous ratings from previous matches. Accordingly, each user may be assured of the integrity of the other user.

In further detail, a match between multiple unique users may be based on at least one or more wash parameters input by each unique user. For example, two unique users may be matched simply on similarities in desired water temperature (e.g., warm, hot, cold). Although differences may exist between each unique user, such as washing article type, the controller may determine that the input differences will not affect an outcome of the joint washing operation, such as damage to the washing articles. Additionally or alternatively, the controller may match unique users according to wash (or wash basket) size. For example, the controller may determine that a unique user having a medium sized washing load may only be matched with one or two unique users having small sized washing loads. Moreover, the controller may determine that each wash parameter input must be matched in order to create the joint washing operation. For instance, a single wash parameter may be different between two unique users, such as a color of wash articles, which would result in undesirable outcomes for at least one of the unique users. Accordingly, the controller may determine that the potential match is eliminated.

Additionally or alternatively, the controller may present the first or second unique user with a list of potential matches. The first or second unique user may then select a desired match with which to perform the joint washing operation. Moreover, unique users may establish connections according to successful operations. The controller may store this information and alert connected matches as to another connected match's desire to perform a joint washing operation.

Upon matching, for example, the first unique user with the second unique user, the controller may then determine a first wash basket to be used by the first unique user and a second wash basket to be used by the second unique user. In detail, the controller may receive an input from the first unique user including the wash parameters. For one example, the first unique user may input that they have a medium sized wash load. The controller may then associate a medium sized wash basket (e.g., medium wash basket 1122) with the first unique user. Similarly, the second unique user may input that they have a small sized wash load. The controller may then associate a small sized wash basket (e.g., small wash basket 1121) with the second unique user.

At step 306, method 300 may include determining a first individual cost for the first unique user and a second individual cost for the second unique user. In detail, upon associating the first wash basket with the first unique user and the second wash basket with the second unique user, the controller may split a total cost of performing the joint washing operation between the first and second unique users. Further to the example given above, the total cost split between the first and second users may be determined according to the individual wash basket used by each unique user. For instance, the first unique user, having a medium sized wash basket would be obligated to pay a larger portion of the total cost compared to the second unique user, having the small sized wash basket. In at least one embodiment, the first unique user would be assigned a cost that is between about 60% and about 70% of the total cost of the joint washing operation. Accordingly, the remaining portion would be assigned to the second unique user.

The controller may accept payments from each of the first unique user and the second unique user remotely. For instance, a mobile application provided on the mobile device of each unique user may include a virtual payment option. The mobile application may be remotely connected with the washing machine. Accordingly, each individual payment from each unique user may be supplied to the washing machine together.

The controller may further determine a total amount of water to be used during the joint washing operation. In determining the total amount of water to be used, the controller may consider one or more of the wash parameters input by the plurality of unique users (e.g., the first and second unique users). For instance, the size of each assigned wash basket (and thus a total volume of washing articles) together with a selected cycle or operation (heavy soil, delicates, bulky, etc.) may determine a total amount of water to be used in the joint washing operation.

At step 308, method 300 may include receiving confirmation from each of the first and second unique users. In detail, upon determining the associated individual costs for each unique user, the controller may notify each user of the selected and/or determined options. In at least some embodiments, the controller sends a notification to each unique user (e.g., via mobile communication). The notification may include all of the determined factors together with a request to confirm the joint washing operation. The proposed date and time for performing the joint washing operation may be included in the notification. Accordingly, each unique user may confirm the scheduled joint washing operation. For instance, each user may press a button (e.g., on a touch-screen of a connected mobile device) indicating that the joint washing operation has been confirmed.

At step 310, method 300 may include generating the joint washing operation in accordance with the set of washing parameters. In response to receiving the confirmation from each of the first unique user and the second unique user, the controller may generate the joint washing operation, including the wash parameters input and/or determined. The joint washing operation may include the total amount of water to be used, a number of cycles to perform (e.g., fill cycles, agitation cycles, drain cycles, rinse cycles, spin cycles, etc.). The joint washing operation may then be stored, for instance, within the controller. In at least some embodiments, the joint washing operation is stored within the controller on board the washing machine. Additionally or alternatively, the joint washing operation may be stored on one or more remote devices, such as the mobile devices of each unique user, a remote mainframe, or the like.

The first and second unique users may then meet at a predetermined destination (e.g., a laundromat) at the scheduled time on the scheduled date. The joint washing operation may then be retrieved by the controller and input to the washing machine to be performed. For instance, each unique user may obtain the associated was basket (e.g., medium sized and small sized) and place their washing articles therein. The wash baskets may then be placed into the tub (e.g., tub 108). For instance, the wash baskets may be stacked onto a column (e.g., axial column 132) within the tub. The associated wash baskets may be stacked in any suitable order, for instance, having larger wash baskets placed at the bottom of the stack.

Once each wash basket is accommodated within the tub, the controller may initiate the joint washing operation. For instance, continuing with the example provided above, the washing machine may have accepted remote payments from each of the first and second unique users. Thus, the washing machine may load the joint washing operation including all of the wash parameters to be performed. The controller may then perform the joint washing operation.

According to the embodiments described herein, multiple users may use a single washing machine to perform a joint washing operation. The washing machine may include a tub capable of accommodating multiple wash baskets therein. The multiple wash baskets may be stacked axially within the tub. A controller within the washing machine may be in remote communication with mobile devices registered to each user wishing to perform the joint washing operation. Each user may input a plurality of wash parameters to their mobile device, such as through a mobile application. The controller may then match two or more users with the same wash parameters together to form a wash group. The controller may then determine an individual cost for each user based on a size of wash basket selected by each user. Upon receiving a confirmation from each user, the controller may generate the joint washing operation. Each user may obtain their selected basket, place the washing articles therein, and stack the wash baskets within the tub. Upon receiving each individual payment tied to each individual cost, the controller may perform the joint washing operation. Advantageously, users may split the cost of a washing operation to save money. Moreover, including more washing articles into each washing operation may increase machine efficiency and save water use over time.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry treatment appliance defining a vertical direction, a lateral direction, and a transverse direction, the laundry treatment appliance comprising:

a cabinet defining a receiving space;

a wash tub provided within the receiving space, the wash tub comprising an axial column, the axial column configured to receive multiple wash baskets stacked axially; and a controller provided within the cabinet, wherein the controller is configured for:

receiving wash cycle requests from a plurality of unique users, wherein each of the wash cycle requests comprises a corresponding set of wash parameters;

matching a first unique user having a first set of wash parameters and a second unique user having a second set of wash parameters from the plurality of unique users, wherein the first set of wash parameters and the second set of wash parameters are complementary to each other and collectively define a matching set of wash parameters;

determining a first individual cost for the first unique user and a second individual cost for the second unique user in response to matching the first unique user and the second unique user;

receiving a confirmation from each of the first and second unique users; and generating a joint washing operation in accordance with the matching set of washing parameters.

2. The laundry treatment appliance of claim 1, wherein the controller is further configured for:

associating a first wash basket with the first unique user and a second wash basket with the second unique user; and determining a total amount of water required to perform a washing operation in response to associating the first and second wash baskets.

3. The laundry treatment appliance of claim 2, wherein the matching set of wash parameters comprises one or more wash parameters, and wherein the matching the first unique user and the second unique user comprises:

determining that at least one of the one or more wash parameters is identical for the first unique user and the second unique user.

4. The laundry treatment appliance of claim 3, wherein the one or more wash parameters comprise a size of each of the first and second wash baskets, a type of washing article, a color of washing article, a size of a load of washing articles, or a temperature of water for the joint washing operation.

5. The laundry treatment appliance of claim 4, wherein the one or more wash parameters further comprise a date for performing the joint washing operation and a time for performing the joint washing operation.

6. The laundry treatment appliance of claim 4, wherein the controller is further configured for:

initiating the joint washing operation in accordance with the matching set of washing parameters.

7. The laundry treatment appliance of claim 2, wherein the multiple wash baskets comprise a large wash basket, a medium wash basket, and a small wash basket.

8. The laundry treatment appliance of claim 7, wherein each of the multiple wash baskets comprises:

a perforated bottom panel defining an outer diameter and an inner diameter;

a perforated external wall extending upward from the perforated bottom panel at the outer diameter; and a central wall extending upward from the perforated bottom panel at the inner diameter, the central wall being concentric with the perforated external wall.

9. The laundry treatment appliance of claim 8, wherein the outer diameter of each the large wash basket, the medium wash basket, and the small wash basket are equal to each other, and wherein a height of the perforated external wall of the large wash basket is greater than a height of the perforated external wall of the medium wash basket, and the height of the perforated external wall of the medium wash basket is greater than a height of the perforated external wall of the small wash basket.

10. The laundry treatment appliance of claim 1, further comprising:

a wireless connection module provided within the controller, wherein the receiving the wash cycle requests to perform the joint washing operation from the plurality of unique users comprises receiving a signal from a remote device registered to each of the first and second unique users.

11. A method of operating a laundry treatment appliance, the laundry treatment appliance comprising a cabinet, a wash tub provided within the cabinet, and multiple wash baskets stacked axially within the wash tub, the method comprising:

receiving wash cycle requests from a plurality of unique users, wherein each of the wash cycle requests comprises a corresponding set of wash parameters;

matching a first unique user having a first set of wash parameters and a second unique user having a second set of wash parameters from the plurality of unique users, wherein the first set of wash parameters and the second set of wash parameters are complementary to each other and collectively define a matching set of wash parameters;

determining a first individual cost for the first unique user and a second individual cost for the second unique user in response to matching the first unique user and the second unique user;

receiving a confirmation from each of the first and second unique users; and generating a joint washing operation in accordance with the matching set of washing parameters.

12. The method of claim 11, further comprising:

associating a first wash basket with the first unique user and a second wash basket with the second unique user;

determining a total amount of water required to perform a washing operation in response to associating the first and second wash baskets.

13. The method of claim 12, wherein the matching set of wash parameters comprises one or more wash parameters, and wherein the matching the first unique user and the second unique user comprises:

determining that at least one of the one or more wash parameters is identical for the first unique user and the second unique user.

14. The method of claim 13, wherein the one or more wash parameters comprise a size of each of the first and second wash baskets, a type of washing article, a color of washing article, a size of a load of washing articles, or a temperature of water for the joint washing operation.

15. The method of claim 14, wherein the one or more wash parameters further comprise a date for performing the joint washing operation and a time for performing the joint washing operation.

16. The method of claim 14, further comprising:

initiating the joint washing operation in accordance with the matching set of washing parameters.

17. The method of claim 12, wherein the multiple wash baskets comprise a large wash basket, a medium wash basket, and a small wash basket.

18. The method of claim 17, wherein each of the multiple wash baskets comprises:

a perforated bottom panel defining an outer diameter and an inner diameter;

a perforated external wall extending upward from the perforated bottom panel at the outer diameter; and a central wall extending upward from the perforated bottom panel at the inner diameter, the central wall being concentric with the perforated external wall.

19. The method of claim 18, wherein the outer diameter of each the large wash basket, the medium wash basket, and the small wash basket are equal to each other, and wherein a height of the perforated external wall of the large wash basket is greater than a height of the perforated external wall of the medium wash basket, and the height of the perforated external wall of the medium wash basket is greater than a height of the perforated external wall of the small wash basket.

20. The method of claim 11, wherein the laundry treatment appliance further comprises:

a controller comprising a wireless connection module, wherein the receiving the wash cycle requests to perform the joint washing operation from the plurality of unique users comprises receiving a signal from a remote device registered to each of the first and second unique users.

* * * * *